US008596511B2

(12) United States Patent
Marshall, Jr. et al.

(10) Patent No.: US 8,596,511 B2
(45) **Date of Patent: *Dec. 3, 2013**

(54) EXHAUST DEFLECTOR FOR PNEUMATIC POWER TOOL

(71) Applicant: Black & Decker Inc., Newark, DE (US)

(72) Inventors: Rex Allen Marshall, Jr., White Marsh, MD (US); Andrzej R. Wojcicki, Rosedale, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/746,786

(22) Filed: Jan. 22, 2013

(65) Prior Publication Data

US 2013/0126579 A1 May 23, 2013

Related U.S. Application Data

(63) Continuation of application No. 11/811,608, filed on Jun. 11, 2007, now Pat. No. 8,376,205, which is a continuation-in-part of application No. 11/497,030, filed on Jul. 31, 2006, now abandoned.

(51) Int. Cl.
*B25C 1/04* (2006.01)

(52) U.S. Cl.
USPC ..... 227/130; 227/131

(58) Field of Classification Search
USPC ..... 227/130, 131; 224/269; 60/695; 415/191; 251/212
See application file for complete search history.

(56) References Cited

U.S. PATENT DOCUMENTS

| | | | |
|---|---|---|---|
| 3,055,344 | A | 9/1962 | Fisher |
| 3,063,421 | A | 11/1962 | Fisher |
| 3,329,068 | A | 7/1967 | Klaus |
| 3,527,142 | A | 9/1970 | Obergfell |
| 4,962,787 | A | 10/1990 | Mayhew |
| 5,110,030 | A | 5/1992 | Tanji |
| 5,180,091 | A | 1/1993 | Ota |

(Continued)

FOREIGN PATENT DOCUMENTS

| | | | |
|---|---|---|---|
| DE | 3216696 | A1 | 12/1982 |
| DE | 4431771 | A1 | 3/1995 |

(Continued)

OTHER PUBLICATIONS

Tools of the Trade On-Line; "Tool Test: Brad Nailers" print out from website www.toolsofthetrade.net.
Ridgid Operator's Manual for Brad Nailer (Model R21BNA).
15 sheets of photos of prototype of present disclsoure.

*Primary Examiner* — Alexandra Elve
*Assistant Examiner* — Nathaniel Chukwurah
(74) *Attorney, Agent, or Firm* — Harness, Dickey & Pierce, P.L.C.

(57) ABSTRACT

A pneumatic fastening tool may include a tool housing including a dispensing portion for dispensing a fastener, a handle portion and an inlet configured to receive input of compressed air. A cap assembly may include a cap housing having an opening and mounted to the tool housing. A deflector may be configured to direct exhausted air through an outlet in a first direction. The deflector may have a stem received in the opening. The stem may define a bore extending in a second direction that is distinct from the first direction. A locking member may extend at least partially in the bore and be configured to rotatably capture the deflector relative to the cap housing.

14 Claims, 12 Drawing Sheets

(56) References Cited

U.S. PATENT DOCUMENTS

| | | | | |
|---|---|---|---|---|
| 6,059,166 | A | 5/2000 | Ho et al. | |
| 6,135,213 | A | 10/2000 | Schoeps | |
| 6,145,727 | A | 11/2000 | Mukoyama et al. | |
| 6,296,168 | B1 | 10/2001 | Hung | |
| 6,923,272 | B2 | 8/2005 | Jansson et al. | |
| RE39,009 | E | 3/2006 | Izumisawa | |
| 7,231,990 | B2 | 6/2007 | Lai | |
| 8,376,205 | B2 * | 2/2013 | Marshall et al. | 227/130 |

FOREIGN PATENT DOCUMENTS

| | | | |
|---|---|---|---|
| DE | 19637203 | A1 | 3/1997 |
| DE | 102004050076 | A1 | 6/2005 |
| EP | 0734310 | A1 | 10/1996 |
| EP | 1884329 | A1 | 2/2008 |
| WO | WO-0220221 | A2 | 3/2002 |
| WO | WO-2004065070 | A1 | 8/2004 |

* cited by examiner

EXHAUST DEFLECTOR FOR PNEUMATIC POWER TOOL

CROSS-REFERENCE TO RELATED APPLICATIONS

This application is a continuation of U.S. patent application Ser. No. 11/811,608 filed on Jun. 11, 2007 now issued as U.S. Pat. No. 8,376,205 on Feb. 19, 2013 which is a continuation-in-part of U.S. patent application Ser. No. 11/497,030, filed on Jul. 31, 2006 now abandoned. The disclosures of the above applications are incorporated herein by reference.

FIELD

The present disclosure relates to pneumatic tools, and more particularly to an exhaust assembly for a pneumatic tool.

BACKGROUND

Pneumatic air tools, such as nailers and staplers, are relatively commonplace in the construction trades. Many features of typical pneumatic tools, while adequate for their intended purpose, do not provide the user with a desired degree of flexibility and function. For example, it would be beneficial in some instances to direct the exhaust flow from a pneumatic tool in a desired direction. Accordingly, there remains a need in the art for an improved pneumatic tool.

SUMMARY

A pneumatic fastening tool may include a tool housing including a dispensing portion for dispensing a fastener, a handle portion and an inlet configured to receive input of compressed air. A cap assembly may include a cap housing having an opening and mounted to the tool housing. A deflector may be configured to direct exhausted air through an outlet in a first direction. The deflector may have a stem received in the opening. The stem may define a bore extending in a second direction that is distinct from the first direction. A locking member may extend at least partially in the bore and be configured to rotatably capture the deflector relative to the cap housing.

According to additional features, the deflector may be rotatably mounted to the cap housing and configured to direct exhausted air from the tool in a plurality of user defined directions depending on a rotational orientation of the deflector. A friction member may be disposed between the cap housing and the deflector. The friction member can provide a seal between the cap housing and the deflector while also permitting rotation of the deflector relative to the cap housing. An inboard surface of the cap housing may define a recess formed generally adjacent to the opening. The recess may include an arcuate slot configured to align with the bore of the exhaust stem and slidably accept the locking member during installation of the locking member into the bore.

According to still other features, a bumper can be disposed in the cap housing generally inboard of the deflector. The bumper may include a finger extending therefrom. The finger may extend at least partially into the recess of the cap housing to inhibit retraction of the locking member through the recess. The direction of exhausted air may be transverse to an axis of the bore defined through the stem.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
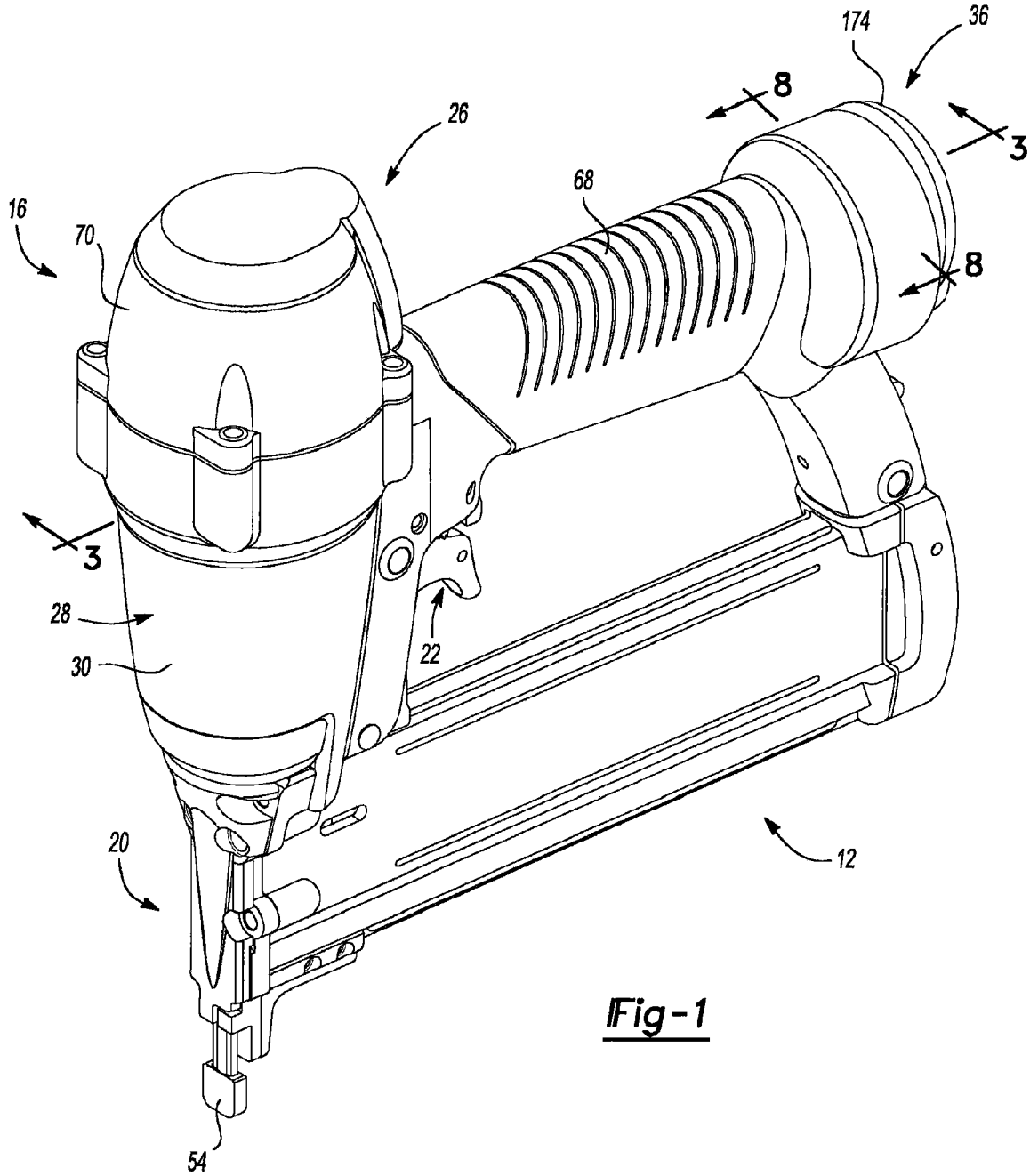
FIG. 1 is a perspective view of a tool constructed in accordance to the present teachings.

With initial reference to FIG. 1, a pneumatic fastening tool constructed in accordance to the present teachings is shown and generally identified at reference numeral 10. The fastening tool 10 may generally include a magazine assembly 12, and a fastening tool portion 16. The fastening tool portion 16 may include a nosepiece assembly 20, a trigger assembly 22, a cap assembly 26, an engine assembly 28, a housing 30 and an exhaust assembly 36.

Figure 2:
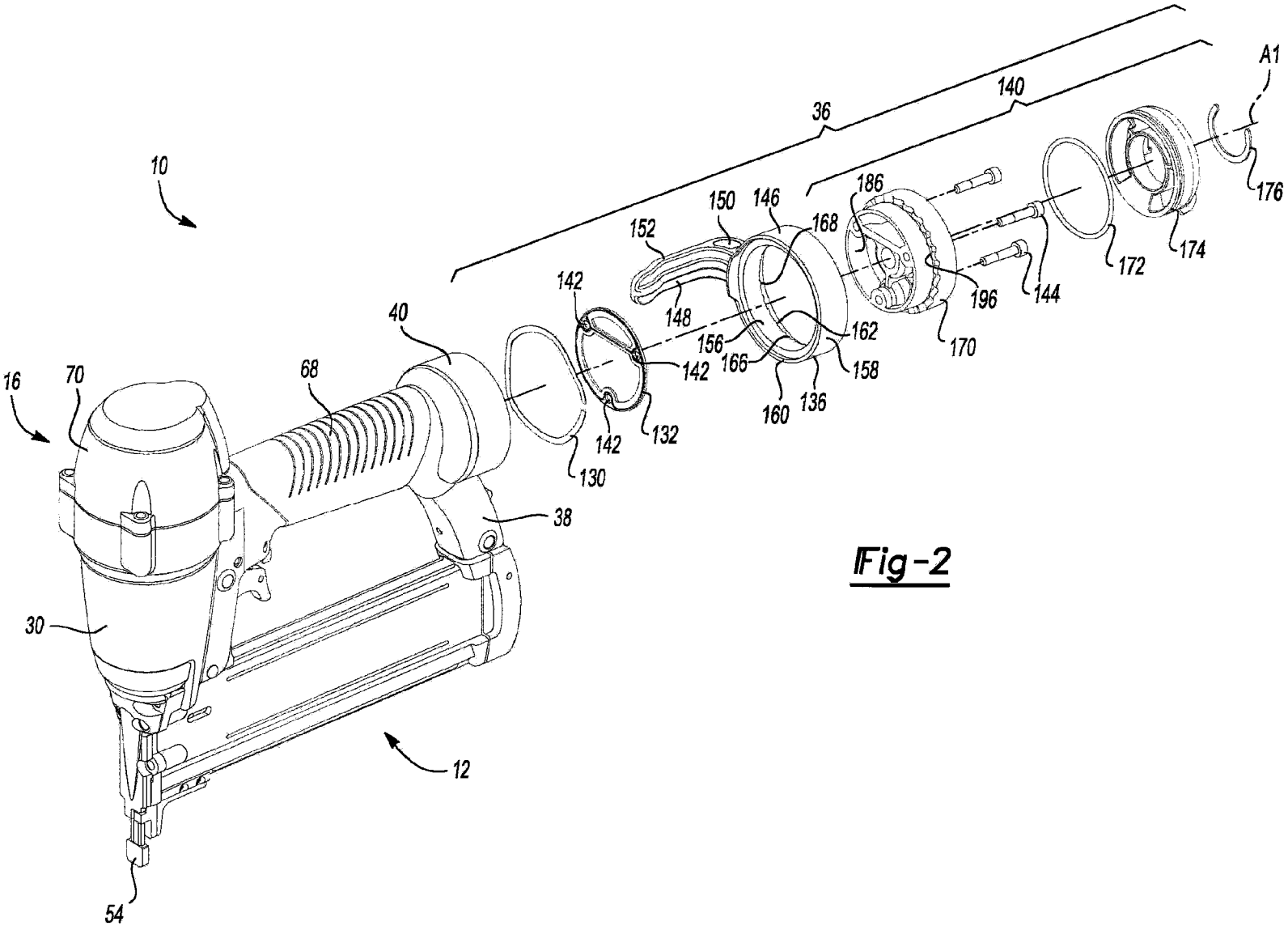
FIG. 2 is a perspective view of the tool of FIG. 1 illustrating the exhaust assembly exploded from a remainder of the tool.
Figure 3:
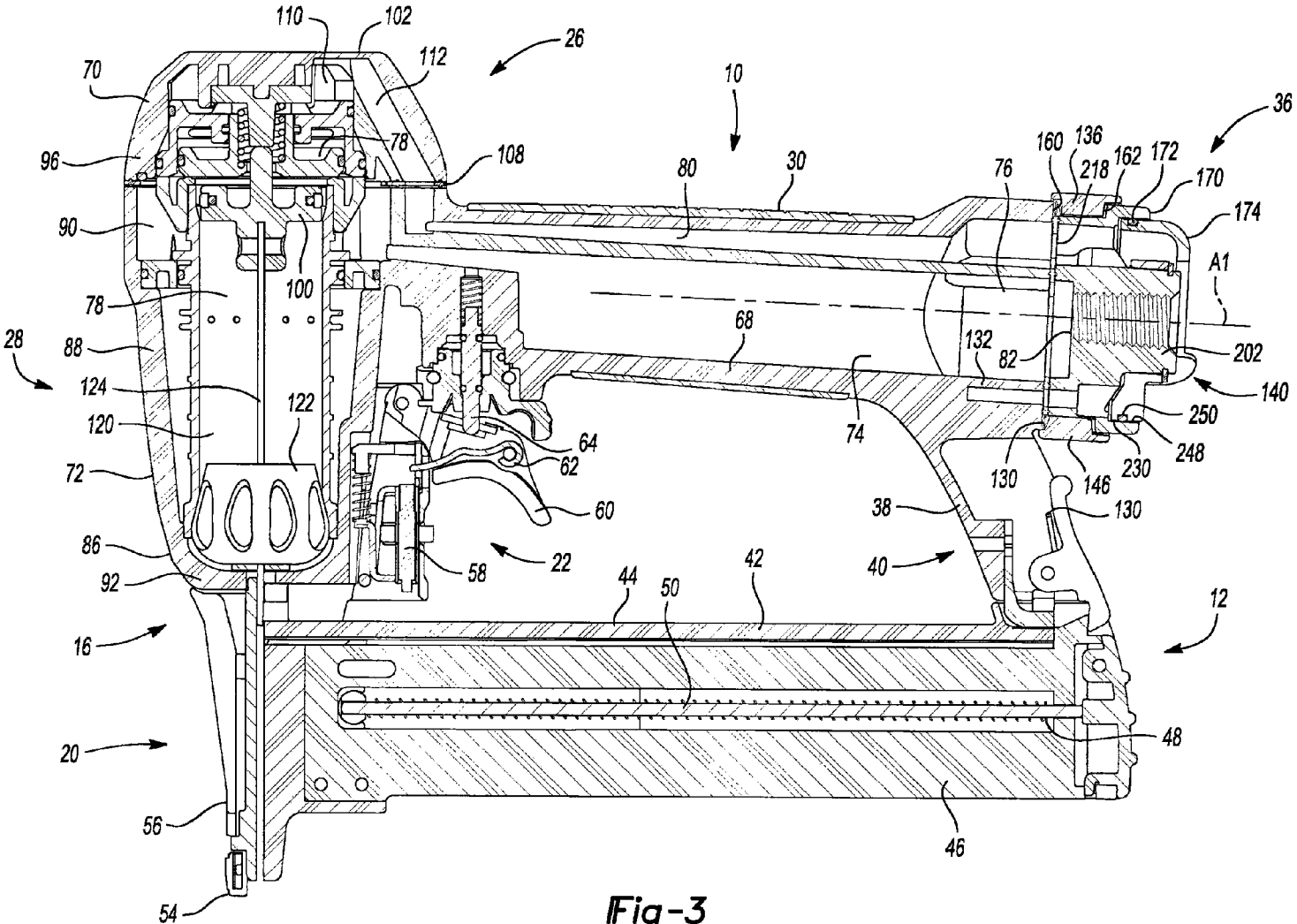
FIG. 3 is a sectional view taken along the line 3-3 of FIG. 1.

With reference to FIGS. 2 and 3, the magazine assembly 12 may extend between the nosepiece assembly 20 and a foot 38 formed at a distal end 40 of the housing 30. The magazine assembly 12 may include a magazine housing 42 having a pair of guide housing portions 44 and 46. A biasing member 48 may be disposed around a central rod 50. The biasing member 48 may be configured to sequentially urge fasteners (not shown) in a direction toward the nosepiece assembly 20 during operation. It is appreciated that the magazine assembly 12 is merely exemplary and other configurations may be employed.

The nosepiece assembly 20 may include a contact trip 54 slidably disposed along a nosepiece body 56. In one example, the contact trip 54 may be adjustable so as to permit the tool operator to vary the depth at which the tool 10 sets the fasteners. A trigger lever 58 may be operably coupled between the contact trip 54 and the trigger assembly 22 in a conventional manner that is well known in the art. The trigger assembly 22 may include a primary trigger 60, a secondary trigger 62 and a trigger valve 64 that selectively controls the flow of compressed air to the engine assembly 28. The primary trigger 60 may be pivotally mounted to the housing 30 and movable in response to the tool operator's finger. Movement of the primary trigger 60 will not, in and of itself, alter the state of the trigger valve 64. Rather, the trigger lever 58 must also move into contact with the secondary trigger 62 before the state of the trigger valve 64 is changed to permit compressed air to flow to the engine assembly 28. Other configurations may be used.

With specific reference now to FIG. 3, the housing 30 may generally define a handle portion 68, a cap portion 70 and an engine portion 72. The housing 30 defines an air passageway 74 having an intake portion 76, a working portion 78 and an exhaust portion 80. More specifically, the intake portion 76 is generally defined between a housing inlet 82 and the trigger valve 64. The working portion 78 is generally defined between the trigger valve 64, through the engine assembly 28 and to the cap assembly 26. The exhaust portion 80 is generally defined from the cap assembly 26 and to the exhaust assembly 36. As illustrated, the intake and exhaust portions 76 and 80, respectively, are each formed through the handle portion 68 of the housing.

The engine portion 72 of the housing 30 may be a container-like structure having a front base 86 and an outwardly tapering sidewall 88 that cooperate to form an engine cavity 90. The outwardly tapering sidewall 88 terminates at the cap assembly 26. The housing 30 may include a piston bumper 92 formed at the engine portion 72.

The cap assembly 26 may include a cap housing 96, an exhaust manifold 98 and a top bumper 100. The cap housing 96 may include an outer cap wall 102 that is generally flat at the rear of the tool 10, but folds over on its sides to form a cup-like container having a generally flat forward face that is configured to engage a housing seal 108. The housing seal 108 permits the cap housing 96 to be sealingly coupled to the rear of the tool housing 30. An annular cap exhaust port 110 directs exhaust into a connecting channel 112. The connecting channel 112 directs exhaust air into the exhaust portion 80 of the air passageway 74.

The engine assembly 28 may include a cylinder 120, a piston 122 and a rod or driver blade 124. In general, when the trigger assembly 22 is actuated to change the state of the trigger valve 64 to an actuated state, air pressure acts on the piston 122 to drive the piston 122 and the driver blade 124 in a direction downwardly as viewed from FIG. 3 so that a tip portion (not specifically shown) of the driver blade 124 drives a fastener (not shown) into a workpiece (not shown). When the state of the trigger valve 64 is changed to its unactuated state, compressed air is routed through the cap assembly 26, through the exhaust portion 80 of the air passageway 74 and to the exhaust assembly 36.

With reference to FIG. 2, the exhaust assembly 36 will be described in greater detail. The exhaust assembly 36 may include a wave spring 130, a gasket 132, a belt hook 136 and a deflector assembly 140. The wave spring 130 may be disposed between the housing 30 and the belt hook 136, while the gasket 132 may be disposed between the housing 30 and the deflector assembly 140. The gasket 132 may define openings 142 adapted to accept fasteners 144 as will be described.

The belt hook 136 can define a cylindrical body 146 and a hook portion 148. The hook portion 148 may include a foundation portion 150 and a finger portion 152. As shown, the foundation portion 150 can extend from the cylindrical body 146 and can transition into the finger portion 152. The finger portion 152 can extend substantially parallel to a longitudinal axis $A_1$ defined by the handle portion 68 of the tool 10. The cylindrical body 146 can include an inner radial surface 156 and an outer radial surface 158. The inner radial surface 156 can define first and second annular ledges 160 and 162, respectively. The first annular ledge 160 may be formed on an inboard side of the cylindrical body 146 and provides an annular pocket to accommodate the wave spring 130 (FIG. 3). The second annular ledge 162 may be formed on an outboard side of the cylindrical body 146. The second annular ledge 162 can define a first interlocking geometry 166. In the example shown, the first interlocking geometry 166 includes a wave-like wall 168. As can be appreciated, the hook portion 148 of the belt hook 136 allows a user to hook the finger portion 152 onto a support such as a user's belt when not in use.

The deflector assembly 140 can include an end cap 170, the fasteners 144, a friction member 172, an exhaust deflector 174 and a retaining ring 176. As will be appreciated from the following discussion, the exhaust deflector 174 is rotatable about the longitudinal axis $A_1$ of the handle portion 68 and is configured to direct exhaust air from the tool 10 in a plurality of user selected directions depending upon its rotational orientation.

Figure 4:
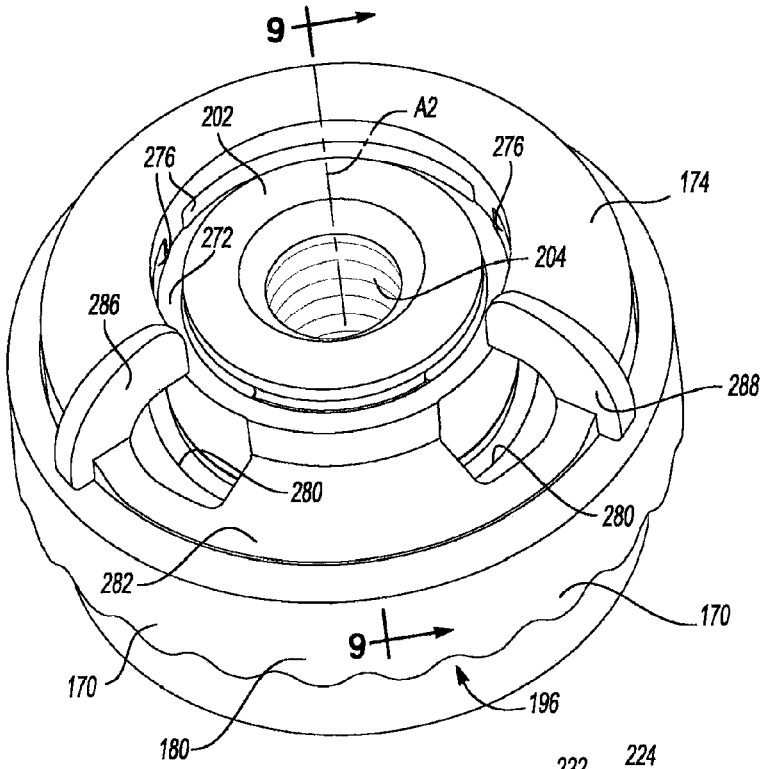
FIG. 4 is a rear perspective view of a portion of the tool of FIG. 1 illustrating an end cap and deflector of the exhaust assembly.
Figure 5:
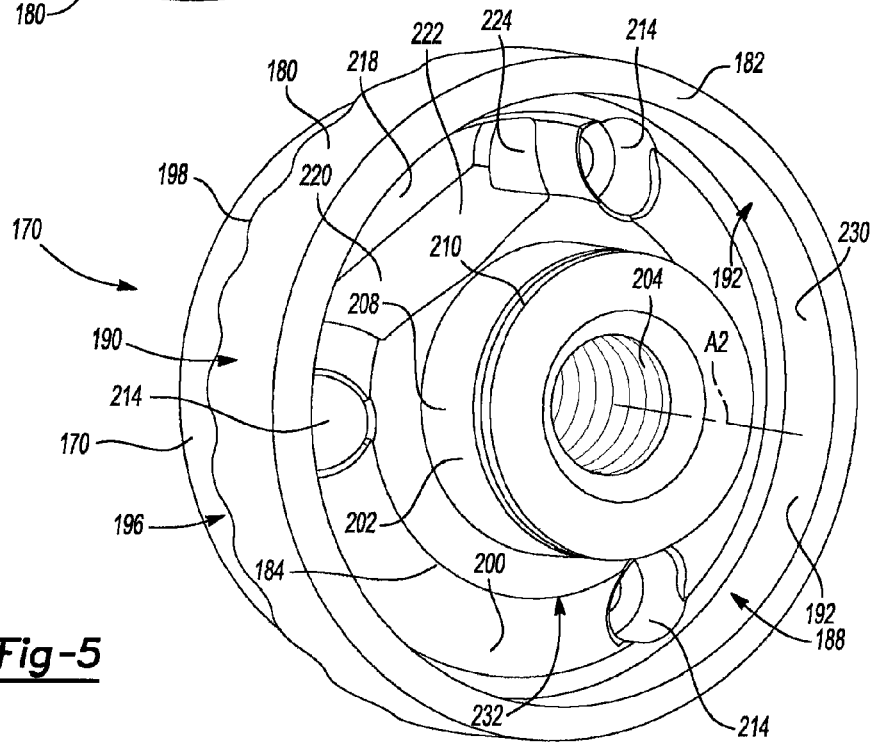
FIG. 5 is a rear perspective view of the end.

With particular reference now to FIGS. 4 and 5, the end cap 170 will be described in greater detail. The end cap 170 can define a cylindrical body portion 180 having a circumferential wall 182 and a central body 184. The cylindrical body portion 180 can include an upstream portion 186 (FIG. 2) and a downstream portion 188. The circumferential wall 182 can define outer and inner circumferential wall surfaces 190 and 192, respectively. The outer circumferential wall surface 190 can define a second interlocking geometry 196. In the example shown, the second interlocking geometry 196 includes a complementary wave-like wall 198.

With reference to FIGS. 2 and 5, it will be appreciated that the wave spring 130 urges the first interlocking geometry 166 of the belt hook 136 into cooperative engagement with the second interlocking geometry 196 of the end cap 170. As a result, relative axial movement (i.e. along axis $A_1$) between the belt hook 136 and the handle portion 68 of the tool 10 is limited. To adjust the rotational orientation of the belt hook 136, a user may urge the belt hook 136 axially toward the handle 68 to compress the wave spring 130. Such action allows the first and second interlocking geometries 166 and 196 to become offset. The user may then rotate the belt hook 136 to a desired rotational orientation. Once the orientation is attained, the user may release the belt hook 136 thereby allowing the wave spring 130 to return the respective interlocking geometries 166 and 196 into engagement. Alternatively, a user may apply sufficient torque to the belt hook 136 to cause the first interlocking geometry 166 to ride over the second interlocking geometry 196 and simultaneously compress the wave spring 130.

Returning to FIGS. 4 and 5, the central portion 184 of the end cap 170 can include an annular land 200 that can extend between the inner circumferential wall surface 192 and a boss 202. The boss 202 can define a central threaded passage 204 for accepting intake air from a pneumatic inlet fitting (not specifically shown). The central passage 204 defines an inlet axis $A_2$. In one example, the longitudinal axis $A_1$ (FIG. 3) may be collinear with the inlet axis $A_2$. An outboard portion 208 of the boss 202 may define an annular pocket 210 adapted to accept the retaining ring 176 (FIG. 2) in an installed position.

A series of bores 214 may be formed through the annular land 200 for accommodating the fasteners 144 (FIG. 2) in the assembled position. The annular land 200 may define an end cap exhaust opening 218. The opening 218 may be defined by the inner circumferential wall surface 192 on the upstream portion 186 of the end cap 170 and a support wall 220 formed on the central portion 184. The support wall 220 may include a linear wall portion 222 and end wall portions 224 connecting the linear wall 222 portion to the inner circumferential wall surface 192. In one example, the end wall portions 224 may substantially conform to the contour of the bores 214 formed through the annular land 200.

As will be appreciated, the end cap exhaust opening 218 is configured to pass exhaust air from the upstream portion 186 (FIG. 2) to the downstream portion 188 of the end cap 170. As best illustrated in FIG. 3, the end cap exhaust opening 218 may be substantially aligned with the exhaust air portion 80 formed in the housing 30 in the assembled position.

Returning to FIG. 5, the inner circumferential wall surface 192 may define a first annular engagement surface 230 on the downstream portion 188. The boss 202 and the first annular engagement surface 230 can be generally opposed and can present an annular space 232 therebetween.

Figure 6:
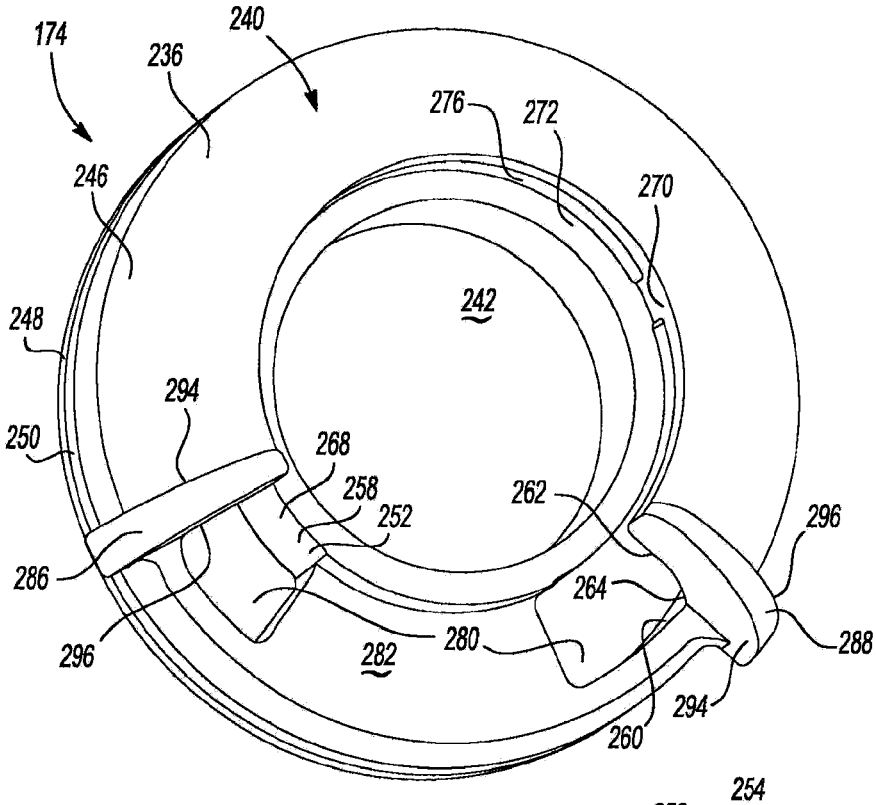
FIG. 6 is a rear perspective view of the deflector.
Figure 7:
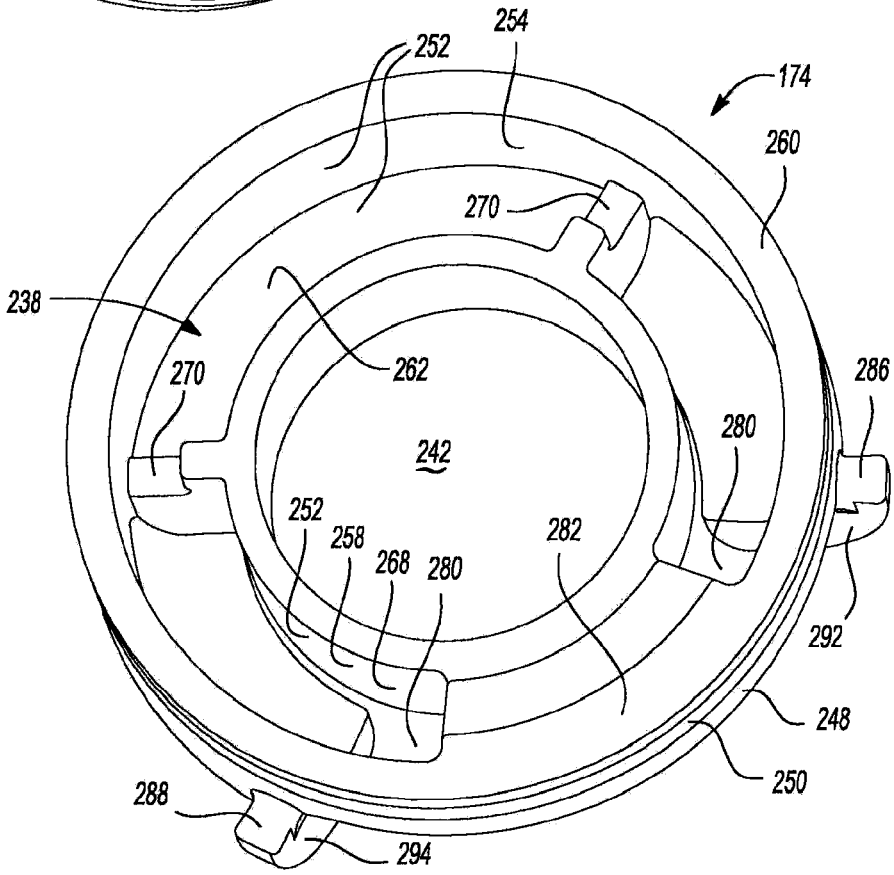
FIG. 7 is a front perspective view of the deflector.
Figure 8:
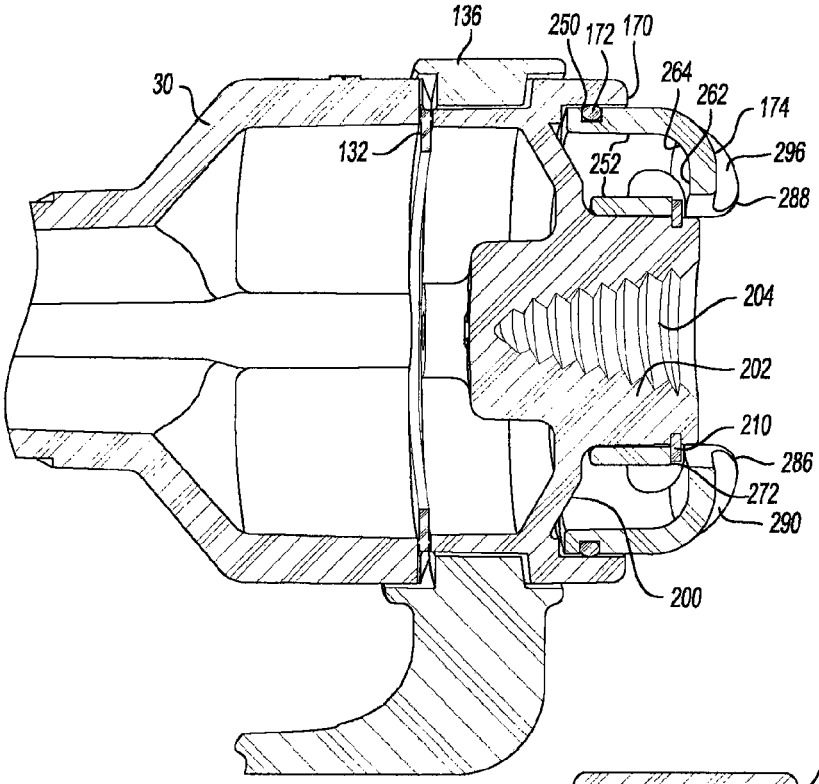
FIG. 8 is a sectional view taken along the line 8-8 of FIG. 1.
Figure 9:
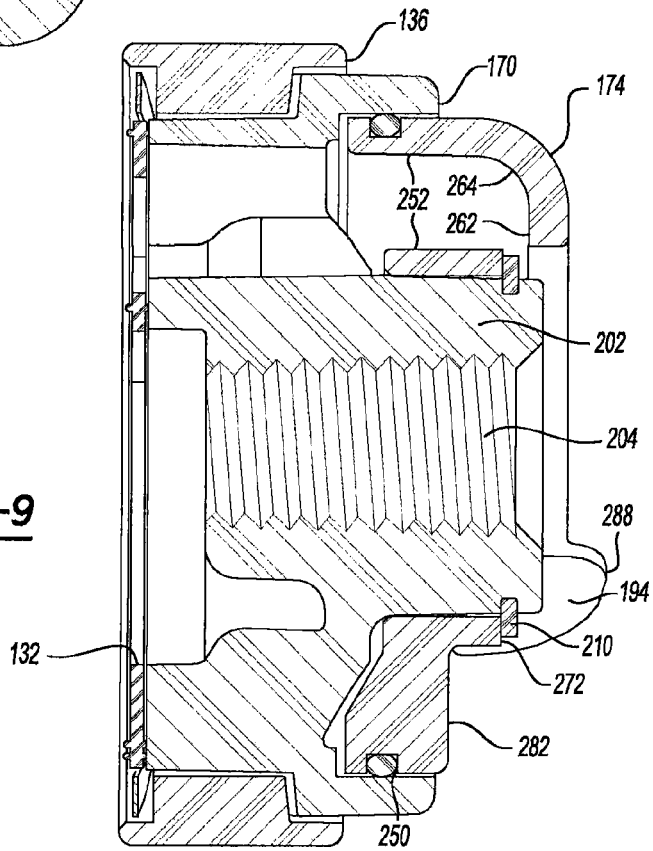
FIG. 9 is a sectional view taken along the line 9-9 of FIG. 4.

With continued reference to FIGS. 3 and 4 and additional reference to FIGS. 6 and 7, the exhaust deflector 174 will be described in greater detail. The exhaust deflector 174 can define a ring-like body portion 236 having an inboard side 238 (FIG. 7) and an outboard side 240 (FIG. 6). The ring-like body 236 can define a central opening 242 for accepting the boss 202 of the end cap 170 in an installed position. An outer wall 246 of the exhaust deflector 174 defines a second annular engagement surface 248 and an annular channel 250. The annular channel 250 is adapted to receive the friction member 172 (FIG. 3). In an installed position, the first annular engagement surface 230 of the end cap 170 opposes the second annular engagement surface 248 of the exhaust deflector 174. The friction member 172 may comprise an o-ring. The friction member 172 maintains an interface between the end cap 170 and the exhaust deflector 174 and facilitates smooth relative rotation of the exhaust deflector 174 about the end cap 170 as will be described in greater detail.

The inboard side 238 of the exhaust deflector can include an air directing surface 252. The air directing surface 252 may include an outboard air-deflecting wall portion 254 and an inboard air-deflecting wall portion 258. The outboard air-deflecting wall portion 254 may include an outer cylindrical wall portion 260, a terminal air-deflecting wall portion 262 and an intermediate radiused wall portion 264 interconnecting the outer cylindrical wall portion 260 and the terminal air-deflecting wall portion 262. The inboard air-deflecting wall portion 258 may include an inner cylindrical wall portion 268. A pair of ribs 270 can interconnect the outboard air-deflecting wall portion 254 and the inboard air-deflecting wall portion 258. The inboard wall portion 258 can define an outboard face 272 (FIG. 6) for engaging the retaining ring 176 in an installed position. A series of radial openings 276 can be defined adjacent the ribs 270.

A pair of exhaust outlets 280 may be defined through the ring-like body portion 236. In one example, the exhaust outlets 280 may be defined on a common quarter portion of the exhaust deflector 174. A planar pie-like connecting wall 282 can extend between the pair of outlets 280. The pie-like connecting wall 282 can define a plane substantially transverse to the inlet axis $A_2$ (FIG. 2). As best shown in FIG. 6, the pie-like connecting wall 282 may be formed inboard relative to the terminal air-deflecting wall 262. The exhaust outlets 280 may define passages generally through the transverse plane. As a result, the exhaust air is permitted to pass through the exhaust outlets 280 in a direction substantially parallel to the inlet axis $A_2$.

A pair of engagement tabs 286 and 288 can be formed at a transition between the exhaust outlets 280 and the terminal air-deflecting wall 262. The engagement tabs 286 and 288 each include opposite lateral walls 294 and 296 that can be spaced apart from one another in a desired manner. In one example, the spacing may decrease in a direction toward the central opening 242 so that the engagement tabs 286 and 288 are tapered. The engagement tabs 286 and 288 as a whole, and more specifically, the lateral walls 294, 296 of the engagement tabs 286 and 288 may generally extend on distinct planes that intersect the input axis $A_2$ (FIG. 5).

As described above, the connecting wall 282 may be formed inboard relative to the terminal air-deflecting wall 262. As a result, the lateral wall 294 of the engagement tab 288 can present a wide engaging face for a user's finger to impart counterclockwise motion (as viewed from FIG. 6) onto the exhaust deflector 174. Similarly, the lateral wall 296 of the engagement tab 286 presents a wide engaging face such as for a user's finger to impart clockwise motion (as viewed from FIG. 6) onto the exhaust deflector 174. It is appreciated that, while lateral walls 296 and 294 of the engagement tabs 288 and 286, respectively, are smaller, compared to their opposite lateral walls 294 and 296, force may also be imparted onto these walls to initiate rotational movement of the exhaust deflector 174.

With reference now to all FIG. 3, operation of the exhaust assembly 36 will be described in greater detail. Air communicated through the exhaust portion 80 of the air passageway 74 passes through the end cap passageway 218 and into the outboard portion 188 (FIG. 5) of the end cap 170. Once in the outboard portion 188 (FIG. 5) of the end cap 170, the air encounters the air directing surface 252 (FIG. 7) of the exhaust deflector 174 and is directed toward and through the outlets 280 (FIG. 7). It is appreciated that some of the exhausted air may escape through the openings 276 (FIG. 6) defined adjacent the ribs 270 (FIG. 6). To alter the position of the outlets 280 (FIG. 7), the user may rotate the exhaust deflector 174 to position the outlets 280 (FIG. 7) at various positions relative to the end cap 170. More specifically, the user may apply force onto the engagement tabs 286 (FIG. 7) and/or 288 (FIG. 7) for changing the rotational position of the exhaust deflector 174. Upon rotation of the exhaust deflector 174, the friction member 172 nested within channel 250 of the exhaust deflector 174 on the second annular engagement surface 248 slidably and sealingly engages with the annular engagement surface 230 of the end cap 170. The friction member 172 provides a seal between the respective engagement surfaces 230 and 248 and also provides constant user feedback around 360 degrees of exhaust deflector rotation.

Figure 10:
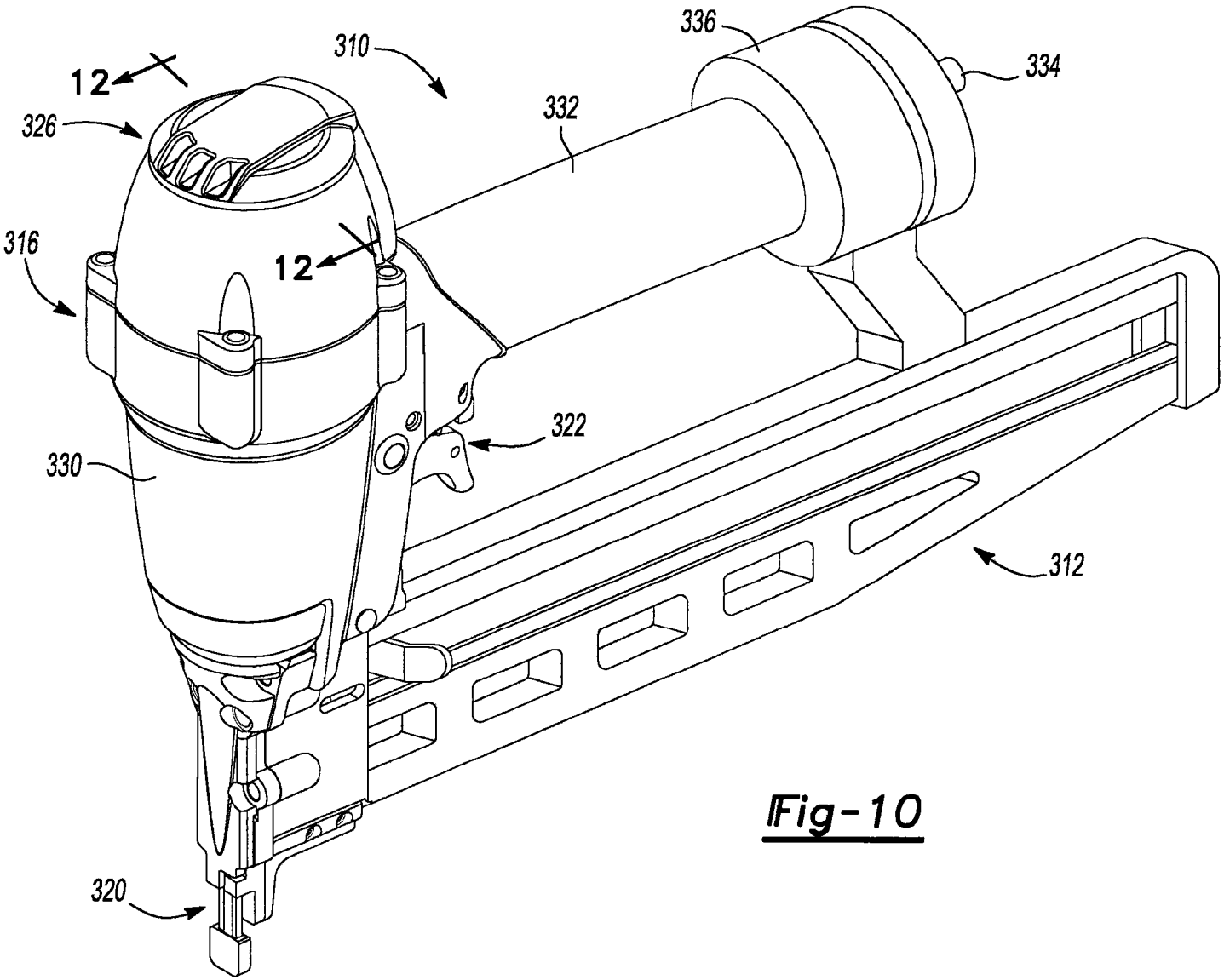
FIG. 10 is a perspective view of another tool constructed in accordance to the present teachings.

With reference now to FIG. 10, a pneumatic fastening tool constructed in accordance to additional features of the present teachings is shown and generally identified at reference 310. The fastening tool 310 may generally include a magazine assembly 312, and a fastening tool portion 316. The fastening tool portion 316 may include a nosepiece assembly 320, a trigger assembly 322, a cap assembly 326, and a housing 330. The housing 330 may generally define a handle portion 332. An air inlet 334 may be defined on a distal end 336 of the handle portion 332.

The pneumatic fastening tool 310 illustrated in FIG. 10 may be configured to divert exhaust air generally upwardly and out of the cap assembly 326. One example of this type of exhaust system is described in co-pending application Ser. No. 11/636,787, the disclosure of which is hereby incorporated by reference as if fully set forth in detail herein. As upward exhaust systems are generally well known in the art, the discussion below will focus primarily on the construction and operation of the cap assembly 326.

Figure 11:
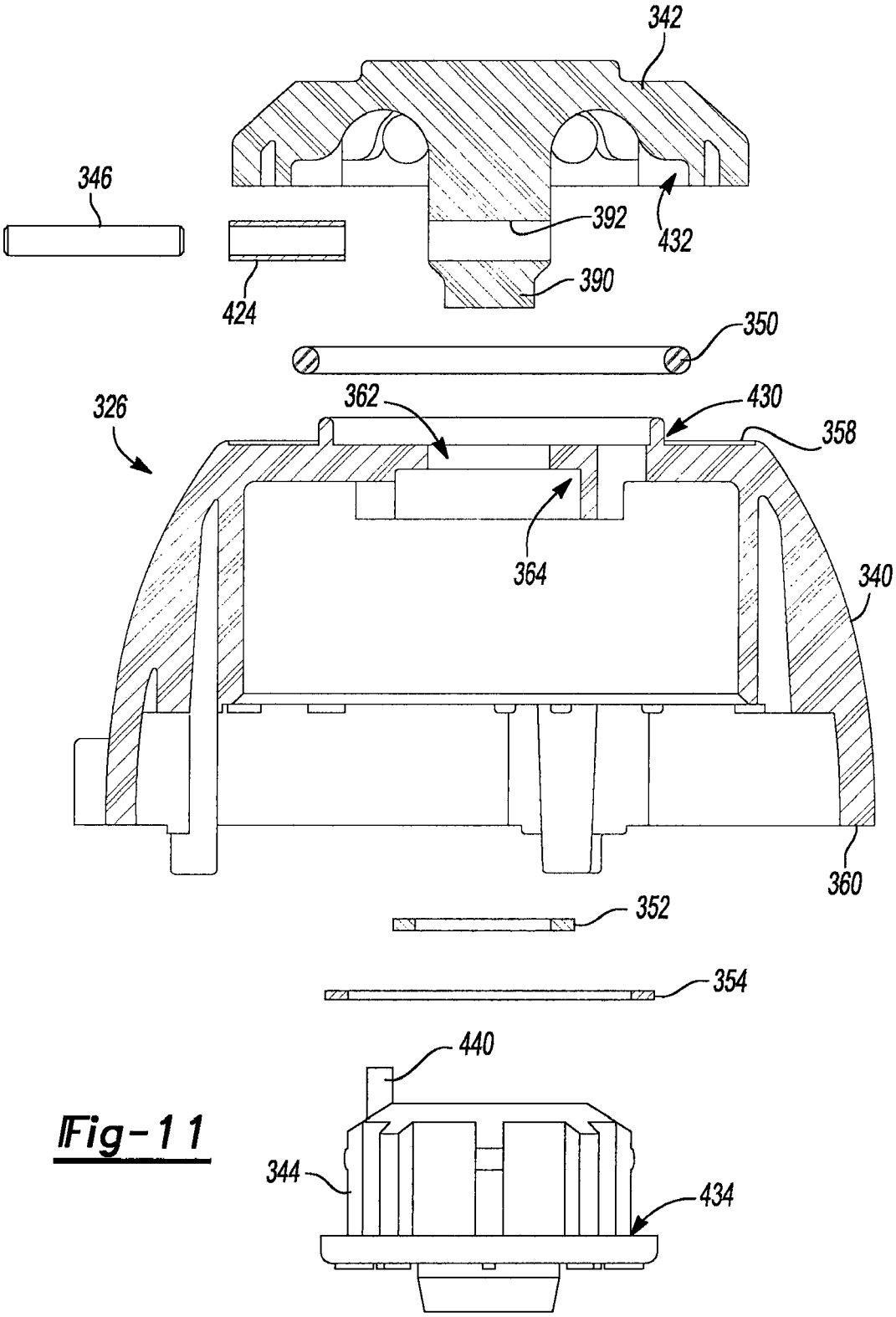
FIG. 11 is an exploded partial sectional view of the cap assembly of the tool of FIG. 10.
Figure 12:
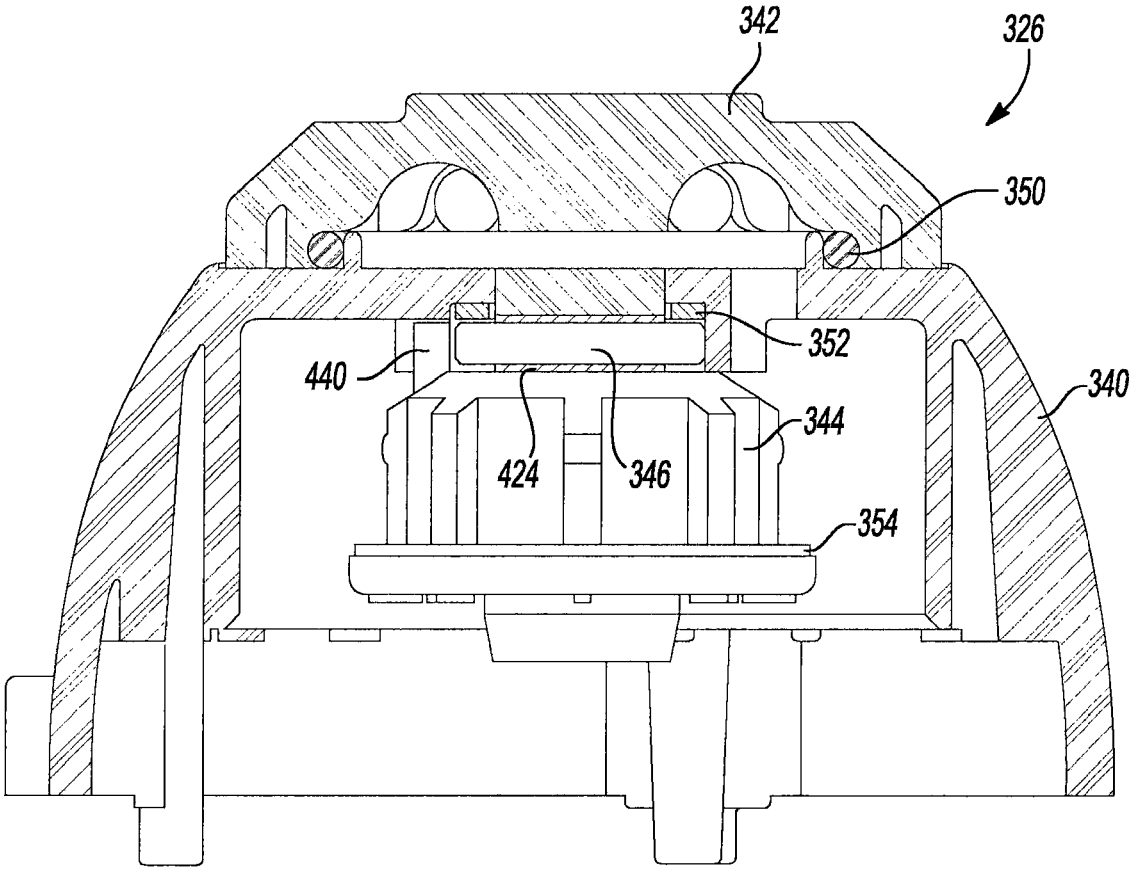
FIG. 12 is an assembled partial sectional view of the cap assembly taken along line 12-12 of FIG. 10.
Figure 13:
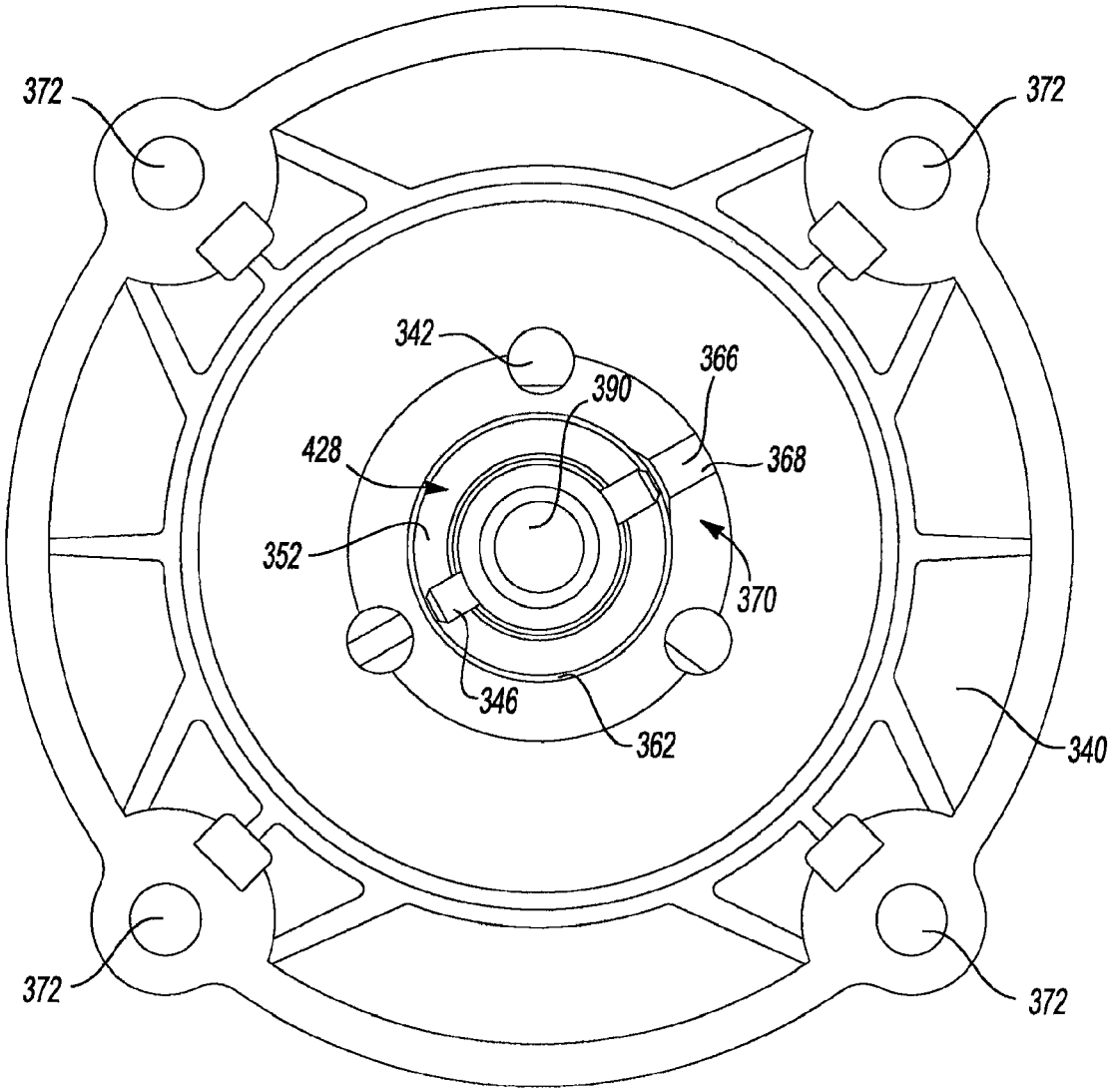
FIG. 13 is a plan view of an inboard surface of the cap of FIG. 11 illustrating the pin locking the exhaust deflector stem in an assembled position.

With reference to FIGS. 11-13, the cap assembly 326 may include a cap housing 340, a deflector 342, a bumper 344, and a locking member 346. The cap assembly 326 may further include a friction member 350 such as an o-ring, a first annular ring 352 and a second annular ring 354. The cap housing 340 may include an outer cap wall 358 that is generally flat at a first end, but folds over on its sides to form a cup-like container having a generally flat forward face 360 that may be configured to engage the housing 330 (FIG. 10) to permit the cap housing 340 to be sealingly coupled to the rear of the housing 330. A central opening 362 may be defined through the first end of the cap housing 340. An annular pocket 364 can be defined in the cap housing 340 generally adjacent to the central opening 362. A recess 366 in the form of an arcuate slot 368 (FIG. 13) may be formed on an inboard face 370 of the cap housing 340 adjacent to the central opening 362. A series of mounting bores 372 (FIG. 13) may be defined around a perimeter of the cap housing 340 for receiving fasteners (not shown).

Figure 14:
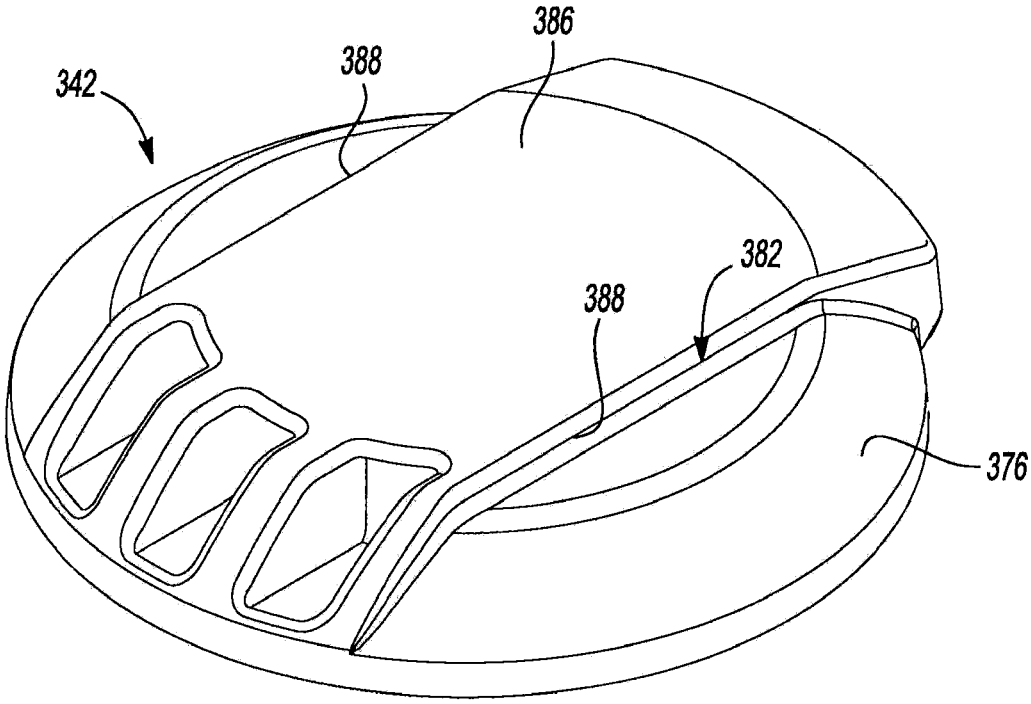
FIG. 14 is a top perspective view of the exhaust deflector of FIG. 11.
Figure 15:
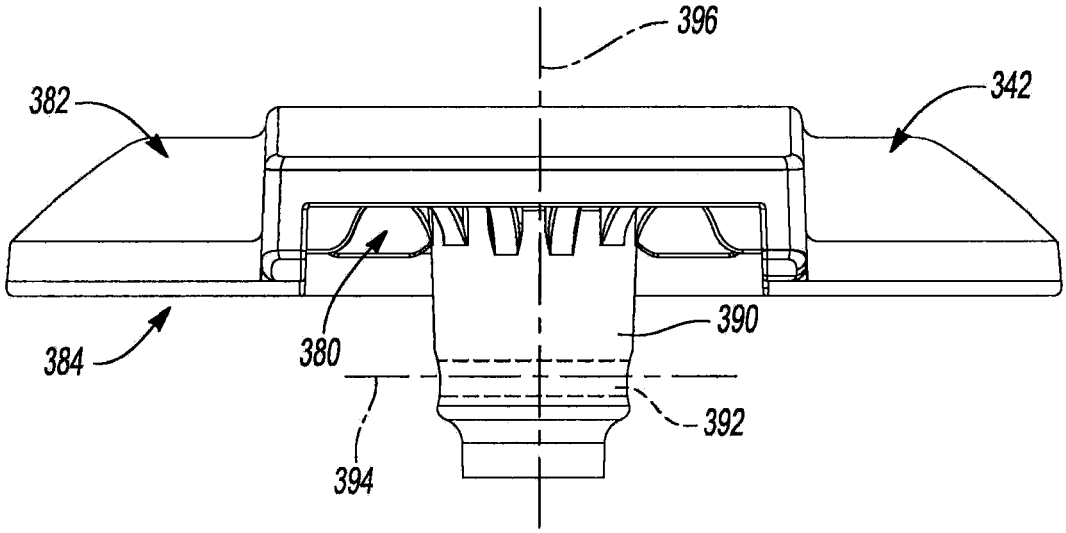
FIG. 15 is a side view of the exhaust deflector of FIG. 14 illustrating the exhaust outlet.
Figure 16:
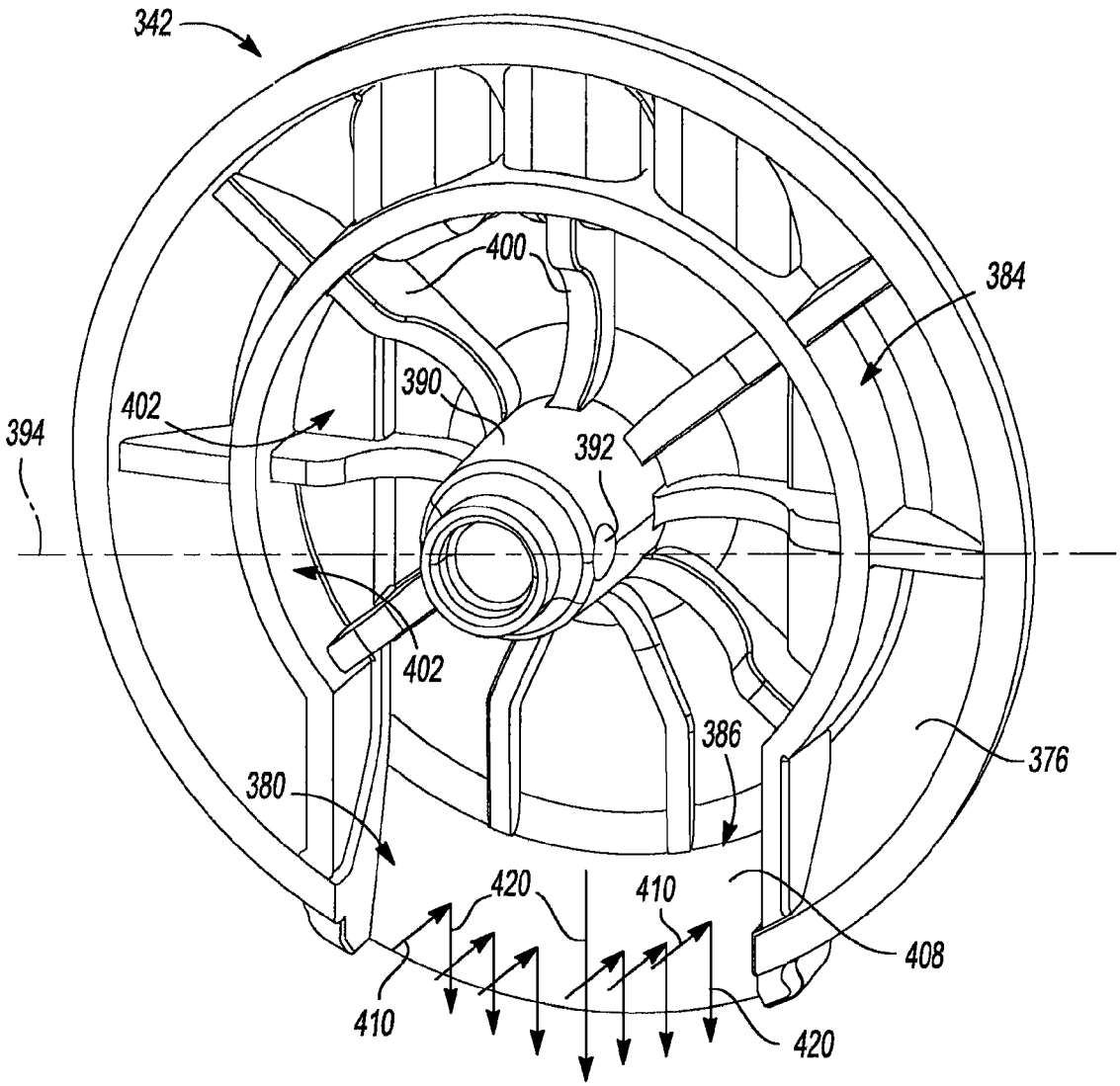
FIG. 16 is a rear perspective view of the exhaust deflector of FIG. 11.

With additional reference now to FIGS. 14-16, the deflector 342 will be described in greater detail. The deflector 342 may generally define a saucer-like body 376 defining an outlet 380 and having an outboard surface 382 (FIG. 14) and an inboard surface 384 (FIG. 16). The saucer-like body 376 may define a chute portion 386. The chute portion 386 may define raised parallel walls 388 extending from the outboard surface 382. A stem 390 may extend from the inboard surface 384. The stem 390 may be generally cylindrical and configured to be received through the central opening 362 of the cap housing 340. The stem 390 may define a bore 392 having an axis 394 (FIG. 15). The axis 394 of the bore 392 may extend through the stem 390 in a direction generally transverse to an axis 396 of the stem 390. The inboard surface 384 can define a plurality of ribs 400 extending radially from the stem 390 (FIG. 15). An air directing surface 402 can be formed on the inboard surface 384. The air directing surface 402 may direct air received through the cap housing 340 in a direction toward the outlet 380. The inboard surface 384 may also define an outlet surface 408 (FIG. 16). During use, exhaust air received by the deflector 342 from the cap housing 340 may travel in a first direction 410, deflect off the inboard surface 384 of the deflector 342 (i.e., the air directing surface 402 and the outlet surface 408) and ultimately through the deflector outlet 380 in a second direction 420. According to additional features, the deflector 342 may be configured to rotate about the stem 390 such that a user can direct exhausted air from the tool 310 in a plurality of user defined directions depending on a rotational orientation of the deflector 342. In one example, the deflector 342 may be unitarily formed of plastic material.

Returning now to FIGS. 11 and 12, in an assembled position, the locking member 346 can extend through the bore 392 of the stem 390 to rotatably capture the deflector 342 relative to the cap housing 340. The locking member 346 may be in the form of a metallic pin. In one example, a sleeve 424 may be disposed around the locking member 346 such that the sleeve 424 and the locking member 346 are collectively located through the bore 392. The sleeve 424 may assist in distributing stress along the length of the locking member 346. The first annular ring 352 can be formed of metallic material and be disposed in the pocket 364 of the cap housing 340 generally between the locking member 346 and the cap housing 340. The locking member 346 may be configured to ride around a surface 428 of the first annular ring 352 upon rotation of the deflector 342 about the stem axis 396.

The friction member 350 may be disposed between an outer annular shoulder 430 (FIG. 11) of the cap housing 340 and an inner annular channel 432 of the deflector 326. The friction member 350 may comprise an o-ring. The friction member 350 can maintain an interface between the cap housing 340 and the deflector 342 and facilitates smooth relative rotation of the deflector 342 about the cap housing 340. The friction member 350 can also provide constant user feedback around 360 degrees of exhaust deflector rotation.

With reference now to FIGS. 12 and 16, some advantages of the locking arrangement of the deflector 342 and cap housing 340 will be described. As best illustrated in FIG. 16, the axis 394 of the bore 392 may be generally transverse to the direction (i.e. the second direction 420) of exhausted air through the outlet 380. As a result, the force exerted onto the outlet surface 408 of the deflector 342 may be distributed evenly across the length of the bore 392 by the locking member 346. More specifically, a retaining force realized between the first annular ring 352 and the locking member 346 (see FIG. 12) may be distributed evenly across the length of the bore 392. According to another advantage, the cap assembly 326 can provide a rotatable deflector without requiring any mounting hardware visible on the outside of the tool.

An exemplary method of assembling the cap assembly 326 will now be described. The sleeve 424 can be inserted into the bore 392. The stem 390 of the deflector 342 can be inserted though the central opening 362 of the cap housing 340. The first annular ring 352 can then be located around the stem 390 from inside of the cap housing 340. Next, with reference to FIG. 13, the deflector 342 can be rotated (i.e. about the axis 396 of the stem 390) to align the bore 392 with the arcuate slot 368 of the cap housing 340. Once aligned, the locking member 346 can be inserted into the sleeve 424 (and therefore through the bore 392). A headvalve sleeve (not shown) can be inserted into the cap housing 340. The second annular ring 354 can locate around a shoulder 434 of the bumper 344 and the bumper 344 can be snapped into place. As shown in FIG. 12, a finger 440 defined on the bumper 344 can extend at least partially into the arcuate slot 368 of the cap housing 340 to preclude withdrawal of the locking member 346 from the bore 392.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A pneumatic fastening tool comprising:

a tool housing including a dispensing portion for dispensing a fastener;

a handle portion;

an inlet configured to receive input of compressed air; and a cap assembly comprising:

a cap housing having an opening and a slot, the cap mounted to the tool housing;

a deflector configured to direct exhausted air through an outlet in a first direction, the deflector having a stem received in the opening, the stem having a cylindrical body that defines a body axis and an outer diameter and defines a bore formed through the outer diameter of the cylindrical body, the bore extending in a second direction, the second direction being distinct from the first direction;

a locking member extending at least partially in the bore and configured to rotatably capture the deflector relative to the cap housing wherein the slot aligns with the bore at only one rotational orientation of the deflector about the body axis; and an annular ring disposed around the stem and between the locking member and the cap housing, the annular ring configured to preclude contact between the locking member and the cap housing, wherein the locking member defines an elongated pin having a length that is accommodated between the outer diameter of the cylindrical body of the stem and an inner diameter of the cap housing during installation of the elongated pin into the bore.

2. A pneumatic fastening tool comprising:

a tool housing including a dispensing portion for dispensing a fastener;

a handle portion;

an inlet configured to receive input of compressed air; and a cap assembly comprising:

a cap housing having an opening and mounted to the tool housing;

a deflector configured to direct exhausted air through an outlet, the deflector having a stem received in the opening, the stem having a body that defines a bore formed through the cylindrical body, wherein the deflector is mounted to the cap housing; and a locking member extending at least partially in the bore and configured to capture the deflector relative to the cap housing;

wherein an inboard surface of the cap housing defines a recess formed generally adjacent to the opening and wherein the recess includes an arcuate slot configured to align with the bore of the stem and slidably accept the locking member during installation of the locking member into the bore wherein the arcuate slot aligns with the bore of the exhaust stem at only one rotational orientation of the deflector about an axis defined by the cylindrical body.

3. The pneumatic fastening tool of claim 2, further comprising a friction member disposed between the cap housing and the deflector, the friction member providing a seal between the cap housing and the deflector while also permitting rotation of the deflector relative to the cap housing.

4. The pneumatic fastening tool of claim 3 wherein the friction member comprises an o-ring.

5. The pneumatic fastening tool of claim 2, further comprising a bumper disposed in the cap housing generally inboard of the deflector.

6. The pneumatic fastening tool of claim 5 wherein the bumper includes a finger extending therefrom, wherein the finger extends at least partially into the recess of the cap housing to inhibit retraction of the locking member through the recess.

7. The pneumatic fastening tool of claim 2, further comprising an annular ring disposed around the stem and between the locking member and the cap housing, the annular ring configured to preclude contact between the locking member and the cap housing.

8. The pneumatic fastening tool of claim 7, wherein the locking member defines an elongated pin having a length that is accommodated between the outer diameter of the cylindrical body of the stem and an inner diameter of the cap housing during installation of the elongated pin into the bore.

9. The pneumatic fastening tool of claim 2 wherein the deflector is rotatably mounted to the cap housing and configured to direct exhausted air from the tool in a plurality of user defined directions depending on a rotational orientation of the deflector.

10. A pneumatic fastening tool comprising:

a tool housing including a dispensing portion for dispensing a fastener;

a handle portion;

an inlet configured to receive input of compressed air; and a cap assembly comprising:

a cap housing mounted to the tool housing;

a deflector configured to direct exhausted air through an outlet in a first direction, the deflector having a stem received by the cap housing, the stem having a cylindrical body defining a first longitudinal axis, the stem further defining a bore extending in a second direction, the second direction being generally transverse to the first direction wherein the deflector is rotatably mounted to the cap housing and configured to direct exhausted air from the tool in a plurality of user defined directions depending on a rotational orientation of the deflector; and a locking member defining a second longitudinal axis and a length greater than the bore and having a first portion extending into the bore and a second portion extending proud from the bore, the locking member configured to rotatably capture the deflector relative to the cap housing, wherein the second longitudinal axis intersects the first longitudinal axis;

wherein an inboard surface of the cap housing defines a recess formed generally adjacent to the opening, the recess including an arcuate slot configured to align with the bore of the exhaust stem and slidably accept the locking member during installation of the locking member into the bore wherein the arcuate slot aligns with the bore of the exhaust stem at only one rotational orientation of the deflector about an axis defined by the cylindrical body.

11. The pneumatic fastening tool of claim 10, further comprising a friction member disposed between the cap housing and the deflector, the friction member providing a seal between the cap housing and the deflector while also permitting rotation of the deflector relative to the cap housing.

12. The pneumatic fastening tool of claim 10, further comprising a bumper disposed in the cap housing generally inboard of the deflector and wherein the bumper includes a finger extending therefrom, wherein the finger extends at least partially into the recess of the cap housing to inhibit retraction of the locking member through the recess.

13. The pneumatic fastening tool of claim 10, further comprising an annular ring disposed around the stem and between the locking member and the cap housing, the annular ring configured to preclude contact between the locking member and the cap housing and wherein the locking member rides around a surface of the annular ring upon rotation of the deflector.

14. The pneumatic fastening tool of claim 10 wherein the elongated pin rides around a surface of the annular ring upon rotation of the deflector about an axis defined by the cylindrical body.

* * * * *